US009010249B2

(12) United States Patent
Miller

(10) Patent No.: US 9,010,249 B2
(45) Date of Patent: Apr. 21, 2015

(54) EXPLOSIVE BULK CHARGE

(71) Applicant: Jacob Lee Miller, Oliver Springs, TN (US)

(72) Inventor: Jacob Lee Miller, Oliver Springs, TN (US)

(73) Assignee: Consolidated Nuclear Security, LLC, Oak Ridge, TN (US)

( * ) Notice: Subject to any disclaimer, the term of this patent is extended or adjusted under 35 U.S.C. 154(b) by 73 days.

(21) Appl. No.: 13/758,416

(22) Filed: Feb. 4, 2013

(65) Prior Publication Data

US 2015/0083009 A1 Mar. 26, 2015

(51) Int. Cl.
*F42B 1/00* (2006.01)
*F42B 1/02* (2006.01)
*F42B 1/036* (2006.01)

(52) U.S. Cl.
CPC .. *F42B 1/02* (2013.01); *F42B 1/036* (2013.01)

(58) Field of Classification Search
CPC ..... F42B 12/10
USPC ..... 102/476, 475, 305–307
See application file for complete search history.

(56) References Cited

U.S. PATENT DOCUMENTS 3,076,408 A * 2/1963 Poulter et al. ..... 89/1.14
3,176,613 A * 4/1965 Godfrey et al. ..... 102/306
3,280,743 A 10/1966 Reuther
3,326,125 A * 6/1967 Silvia et al. ..... 102/305
3,437,036 A * 4/1969 Franzen et al. ..... 102/401
3,613,586 A * 10/1971 Talley et al. ..... 102/476
3,718,512 A * 2/1973 Hurst ..... 149/2
4,646,641 A * 3/1987 Casey ..... 102/306
5,323,681 A 6/1994 McDevitt, Jr.
5,540,156 A 7/1996 Fong
5,859,383 A 1/1999 Davison et al.

* cited by examiner

*Primary Examiner* — Reginald Tillman, Jr.

(74) *Attorney, Agent, or Firm* — Clements Bernard PLLC; Christopher L. Bernard; Lawrence A. Baratta, Jr.

(57) ABSTRACT

An explosive bulk charge, including: a first contact surface configured to be selectively disposed substantially adjacent to a structure or material; a second end surface configured to selectively receive a detonator; and a curvilinear side surface joining the first contact surface and the second end surface. The first contact surface, the second end surface, and the curvilinear side surface form a bi-truncated hemispherical structure. The first contact surface, the second end surface, and the curvilinear side surface are formed from an explosive material. Optionally, the first contact surface and the second end surface each have a substantially circular shape. Optionally, the first contact surface and the second end surface consist of planar structures that are aligned substantially parallel or slightly tilted with respect to one another. The curvilinear side surface has one of a smooth curved geometry, an elliptical geometry, and a parabolic geometry.

15 Claims, 1 Drawing Sheet

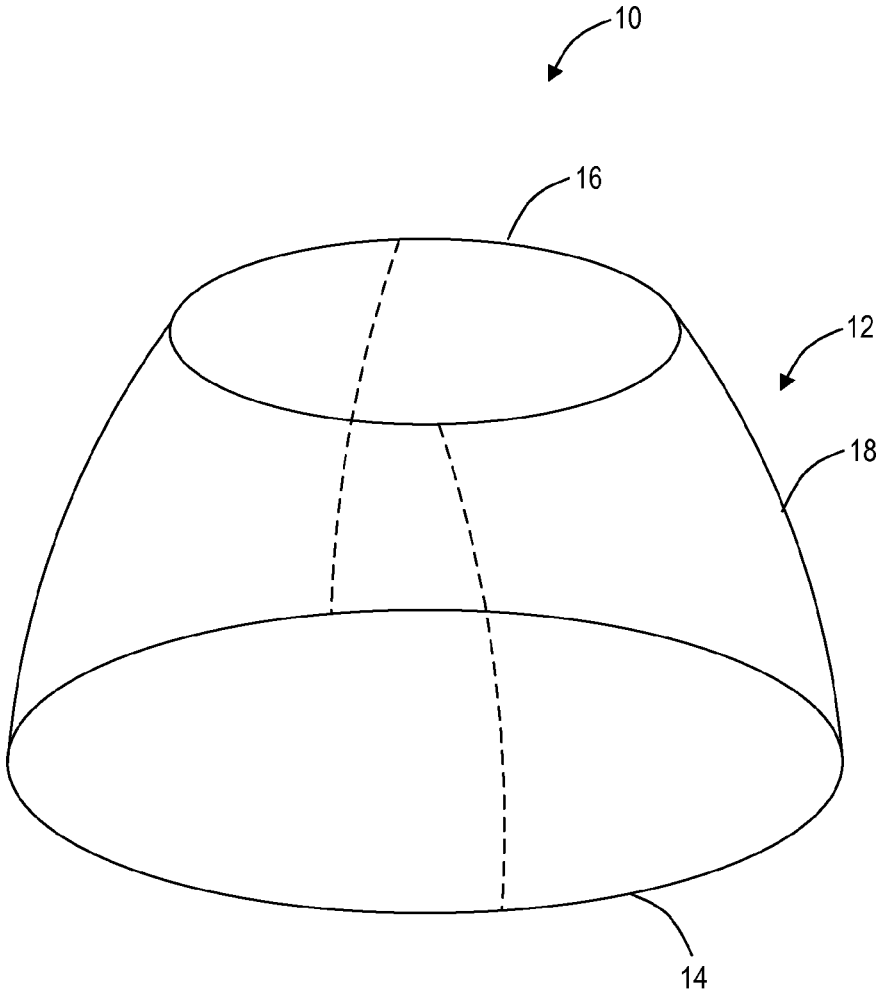
10
16
12
18
14

EXPLOSIVE BULK CHARGE

The U.S. Government has rights to the present disclosure pursuant to Contract No. AC05-00OR22800 between the U.S. Department of Energy and Babcock and Wilcox Technical Services Y-12, LLC.

FIELD OF THE DISCLOSURE

The present disclosure relates generally to an explosive bulk charge. More specifically, the present disclosure relates to an explosive bulk charge that provides exceptional wall or armor breaching performance and novel explosively formed projectile/explosively formed penetrator (EFP) creation, among other advantages.

BACKGROUND OF THE DISCLOSURE

Related to explosive bulk charges, it is typically desirable to increase the penetration and/or through-hole diameter when detonated in contact with a wall, armor, or other structure or material. Likewise, it is typically desirable to increase the velocity of an EFP coupled to or otherwise formed by the explosive bulk charges, such as from an attached plate, precut wall, armor, or other structure or material. In the later case, it is also typically desirable to increase the diameter of the EFP coupled to or formed by the explosive bulk charge.

Conventionally, explosive bulk charges used for breaching and/or EFP formation have had either a square or rectangular contact surface, with right angles, or a random geometry of known mass. In each case, the resulting through-hole is substantially circular. An EFP may be formed by such explosive bulk charges by coupling a plate or the like to them, or by precutting a wall, armor, or other structure or material adjacent to them.

For example, U.S. Pat. No. 3,280,743 deals with the directional control of an explosion and provides:

> an explosive is confined within a [block] shaped mass having a predetermined shaped surface and detonating means is operatively disposed within said mass to define a selected point of initiation from which gaseous energy upon detonation expands in spherical propagating lines of force that pierce the surface and produce a reactionary force for momentarily enveloping and restraining the energy. The reactionary force is greatest at those places on the surface which conform to the spherical propagating lines of force. With such an arrangement, the confined energy will penetrate the reactionary force at its most vulnerable point and will be released therethrough.

Likewise, U.S. Pat. No. 5,323,681 deals with the molding of an explosive and provides:

> [i]t is the primary object of the invention to shape an explosive charge of an EFP in dimensions that improve slug formation, slug cohesion, and flight characteristics thus optimizing the explosive energy that can be directed into an EFP. It is yet another object of this invention to provide a way to apply the requisite amount of explosive to an EFP without the use of scales to weigh the explosive. It is an object of this invention to provide a means to easily extract the explosive charge from the mold after it has been formed. The present invention meets the above mentioned needs using a shaping apparatus comprising a nonmetal mold, formed into a frustum of a cone, with dimensions having a wide base equaling about 18 inches, a narrow base equaling about 3 inches, and a height equaling about 4 inches. The plastic explosive is hand-packed into the mold so that the explosive takes on the frusto-conical shape of the mold. A latch and a hinge are attached to the mold for easy and quick release of the molded explosive charge.

Likewise, U.S. Pat. No. 5,540,156 deals with a technique for producing a selectable effects EFP having the ability to defeat either single armored targets or a multiplicity of lightly armored targets and provides:

> [a]n object of the present invention is to provide a mechanical method for an explosively formed penetrator (EFP) which utilizes two or more rod networks mounted in an overlapping pattern to allow production of more than one controlled fragment size. Another object of the present invention is to provide a rod array for an EFP which allows production of a multiplicity of fragment sizes. Another object of the present invention is to provide a mechanical selection device for an EFP that is simple to manufacture, inexpensive and adaptable to almost any warhead design. A further object of the present invention is to provide an EFP system that is effective against armored targets, such as tanks, armored personnel carriers and light armored targets such as trucks, missile launchers, and communication stations.

Likewise, U.S. Pat. No. 5,859,383 deals with shaped charges that may be used as perforators in the mining and petroleum industries, for example, and provides:

> [t]hese shaped charges may be used as a well perforation system using energetic, electrically-activated reactive blends in place of high explosives. The reactive blends are highly impact inert and relatively thermally inert until activated. The proposed system requires no conventional explosives and it is environmentally benign. The system and its components can be shipped and transported easily with little concern for premature explosion. It also needs no special handling or packing. The performance in oil and gas well perforation can be expected to exceed that of conventional explosive techniques. The fundamental approach of the present invention is to activate reactive blends of metals and oxidizing agents with energetic electrical pulses from a pulsed-power system. Theoretical predictions of pressures and expansion histories can be verified by testing reactive samples activated with energetic electrical pulses. The energy source of choice is a conductive material which can be burst (e.g., melted and vaporized by pulsed electrical current). Of particular interest are conductive materials such as graphite, conductive polymers and metal such as aluminum, zirconium, copper, titanium, lithium, silver, magnesium, beryllium, manganese, tin, iron, nickel, zinc, boron, silicon and the like in an oxidizing environment, or an environment which becomes oxidizing during the pulsing, bursting and subsequent reaction initiation. It is also desirable to have a power source and conductive path to the reaction mixture that will remain effective in the difficult temperature, stress, and shock environment in which the unit will be employed.

However, a significant amount of explosive energy is wasted by conventional explosive bulk charges. For this reason, improved explosive bulk charges are still needed in the art.

BRIEF SUMMARY OF THE DISCLOSURE

In various exemplary embodiments, the present disclosure provides an explosive bulk charge that has a bi-truncated hemispherical shape, providing a substantially circular, elliptical, or partially or wholly curvilinear contact surface, thereby eliminating sharp corners and edges where jetting and overpressure interferences are typically created. A detonator is centrally disposed in a surface opposite the contact surface, with the detonator oriented such that the body of the housing is substantially perpendicular to the target material's surface. The result is an explosive bulk charge demonstrating exceptional wall or armor breaching performance (effectively breaching the wall or armor with a hole that is larger than the substantially circular contact surface) and novel EFP creation (precisely shearing the wall or armor to create a projectile or penetrator, whether or not precut), among other advantages. For example, for concrete clad with armor, the explosive bulk charge has the ability to shear the armor and propel it through the concrete, as opposed to merely fracturing the concrete with bits of armor shrapnel. The explosive bulk charge finds wide applicability in military and civilian operations, including law enforcement, mining, and petroleum operations.

In one exemplary embodiment, the present disclosure provides an explosive bulk charge, including: a first contact surface configured to be selectively disposed substantially adjacent to a structure or material to be destroyed or breached; a second end surface configured to selectively receive a detonator; and a curvilinear side surface joining the first contact surface and the second end surface. The first contact surface, the second end surface, and the curvilinear side surface form a bi-truncated hemispherical structure. The first contact surface, the second end surface, and the curvilinear side surface are formed from an explosive material. Optionally, the first contact surface and the second end surface each have one of a substantially circular shape, a substantially elliptical shape, a rounded square shape, a rounded rectangle shape, and a combination thereof. Optionally, the first contact surface and the second end surface consist of planar structures that are aligned substantially parallel with respect to one another. Alternatively, the first contact surface and the second end surface consist of planar structures that are aligned substantially tilted with respect to one another. The curvilinear side surface has one of a smooth curved geometry, an elliptical geometry, and a parabolic geometry. Optionally, the explosive bulk charge also includes one or more angular structures manufactured into the curvilinear side surface.

In another exemplary embodiment, the present disclosure provides a method for providing an explosive bulk charge, including: providing a first contact surface configured to be selectively disposed substantially adjacent to a structure or material to be destroyed or breached; providing a second end surface configured to selectively receive a detonator; and providing a curvilinear side surface joining the first contact surface and the second end surface. The first contact surface, the second end surface, and the curvilinear side surface form a bi-truncated hemispherical structure. The first contact surface, the second end surface, and the curvilinear side surface are formed from an explosive material. Optionally, the first contact surface and the second end surface each have one of a substantially circular shape, a substantially elliptical shape, a rounded square shape, a rounded rectangle shape, and a combination thereof. Optionally, the first contact surface and the second end surface consist of planar structures that are aligned substantially parallel with respect to one another. Alternatively, the first contact surface and the second end surface consist of planar structures that are aligned substantially tilted with respect to one another. The curvilinear side surface has one of a smooth curved geometry, an elliptical geometry, and a parabolic geometry. Optionally, the method also includes providing one or more angular structures manufactured into the curvilinear side surface.

In a further exemplary embodiment, the present disclosure provides a method for forming an explosive bulk charge, including: forming a first contact surface from an explosive material, the first contact surface configured to be selectively disposed substantially adjacent to a structure or material to be destroyed or breached; forming a second end surface from the explosive material, the second end surface configured to selectively receive a detonator; and forming a curvilinear side surface joining the first contact surface and the second end surface from the explosive material. The first contact surface, the second end surface, and the curvilinear side surface form a bi-truncated hemispherical structure. Optionally, the first contact surface and the second end surface each have one of a substantially circular shape, a substantially elliptical shape, a rounded square shape, a rounded rectangle shape, and a combination thereof. The curvilinear side surface has one of a smooth curved geometry, an elliptical geometry, and a parabolic geometry.

BRIEF DESCRIPTION OF THE DRAWINGS

The present disclosure is illustrated and described herein with reference to the various drawings, in which like reference numbers are used to denote like device components/method steps, as appropriate, and in which:

FIG. 1 is a perspective view of one exemplary embodiment of the explosive bulk charge of the present disclosure.

DETAILED DESCRIPTION OF THE DISCLOSURE

Again, in various exemplary embodiments, the present disclosure provides an explosive bulk charge that has a bi-truncated hemispherical shape, providing a substantially circular, elliptical, or partially or wholly curvilinear contact surface, thereby eliminating sharp corners and edges where jetting and overpressure interferences are typically created. A detonator is substantially centrally disposed in the substantially circular surface opposite the substantially circular contact surface, with the detonator oriented such that the body of the housing is substantially perpendicular to the target material's surface. The result is an explosive bulk charge demonstrating exceptional wall or armor breaching performance (effectively breaching the wall or armor with a hole that is larger than the substantially circular contact surface) and novel EFP creation (precisely shearing the wall or armor to create a projectile or penetrator, whether or not precut), among other advantages. For example, for concrete clad with armor, the explosive bulk charge has the ability to shear the armor and propel it through the concrete, as opposed to merely fracturing the concrete with bits of armor shrapnel. The explosive bulk charge finds wide applicability in military and civilian operations, including law enforcement, mining, and petroleum operations.

Referring specifically to FIG. 1, in one exemplary embodiment, the explosive bulk charge 10 of the present disclosure includes a bi-truncated hemispherical body 12 having a first substantially circular (or elliptical or partially or wholly curvilinear) contact surface 14, a second substantially circular (or elliptical or partially or wholly curvilinear) end surface 16, and a substantially curvilinear side surface 18. The separation and diameters of the first substantially circular contact surface 14 and the second substantially circular end surface 16 may be selected and varied as desired. Preferably, the diameter of the first substantially circular contact surface 14 is larger than the diameter of the second substantially circular end surface 16, and the first substantially circular contact surface 14 and the second substantially circular end surface 16 reside in substantially parallel planes. However, the planes may be slightly tilted with respect to one another, such that a directional explosion may be generated. The substantially curvilinear side surface 18 may have any smooth curved geometry, and may be elliptical, parabolic, etc. Importantly, sharp corners and edges are minimized, thereby minimizing jetting and overpressure interferences. However, optionally, sharp corners or edges may be selectively utilized along the substantially curvilinear side surface 18 or elsewhere to effect specific outputs beyond a through-hole diameter. It will be readily apparent to those of ordinary skill in the art that the first contact surface 14 and the second end surface 16 may have other smooth curved geometries as well, as opposed to being strictly circular where they intersect with the substantially curvilinear side surface 18.

The explosive bulk charge 10 is made from C4 or the like (i.e., a Composition C plastic explosive). As is well known to those of ordinary skill in the art, C4 consists of an explosive, a plastic binder, a plasticizer, and, optionally, a marker or odorizing taggant chemical, such as 2,3-dimethyl-2,3-dinitrobutane (DMDNB) or the like, to help detect the explosive and identify its source. The explosive is RDX (cyclonite or cyclotrimethylene trinitramine), which makes up about 90% of the C4 by mass. The plasticizer is diethylhexyl (about 5%) or dioctyl sebacate, and the binder is polyisobutylene (about 2%). Another plasticizer used is dioctyl adipate (DOA). A small amount of SAE 10 non-detergent motor oil (about 1.5%) is also added. C4 is manufactured by combining the ingredients with binder dissolved in a solvent. The solvent is then evaporated and the mixture dried and filtered. The final material is a solid with a texture similar to that of modeling clay. It will be readily apparent to those of ordinary skill in the art that other plastic, moldable, castable, or formable explosives may also be used with equal success.

The explosive bulk charge 10 is formed by pour casting or pressing and hammering the C4 or the like into a mixing bowl lined with a mold releasing material or agent, such that the formed explosive bulk charge 10 may be easily removed. Optionally, the explosive bulk charge 10 is covered with a thin layer of rigid material (not illustrated) to assist in maintaining its form and/or aid in attaching it to a structure or object for detonation. In theory, thicker layers could be used to increase the mass efficiency of the explosive bulk charge 10. Likewise, a plate or the like (not illustrated) may be attached to the first substantially circular contact surface 14 to form a coupled EFP.

In use, a detonator (not illustrated) is substantially centrally disposed in the second substantially circular end surface 16 opposite the first substantially circular contact surface 14, with the detonator oriented such that the body of the housing is substantially perpendicular to the target material's surface. The first substantially circular contact surface 14 is disposed adjacent to the structure or material to be destroyed or breached and, upon detonation of the explosive bulk charge 10, forms a through-hole through the structure or material and/or propels an EFP through the material or structure. Optionally, this EFP is formed from the attached plate or the like, or, alternatively, from the structure or material itself, without the need to precut the structure or material. Such functionality is enabled by the novel configuration of the explosive bulk charge of the present disclosure.

Although the present disclosure has been illustrated and described herein with reference to preferred embodiments and specific examples thereof, it will be readily apparent to those of ordinary skill in the art that other embodiments and examples may perform similar functions and/or achieve like results. All such equivalent embodiments and examples are within the spirit and scope of the present disclosure, are contemplated thereby, and are intended to be covered by the following claims.

What is claimed is:

1. An explosive bulk charge, comprising:

a first contact surface configured to be selectively disposed substantially adjacent to a structure or material;

a second end surface configured to selectively receive a detonator; and a curvilinear side surface joining the first contact surface and the second end surface;

wherein the first contact surface, the second end surface, and the curvilinear side surface form a solid bi-truncated hemispherical structure formed from an explosive material.

2. The explosive bulk charge of claim 1, wherein the first contact surface and the second end surface each have one of a substantially circular shape, a substantially elliptical shape, a rounded square shape, a rounded rectangle shape, and a combination thereof.

3. The explosive bulk charge of claim 1, wherein the first contact surface and the second end surface comprise planar structures.

4. The explosive bulk charge of claim 3, wherein the first contact surface and the second end surface comprise planar structures that are aligned substantially parallel with respect to one another.

5. The explosive bulk charge of claim 1, wherein the curvilinear side surface comprises one of a smooth curved geometry, an elliptical geometry, and a parabolic geometry.

6. The explosive bulk charge of claim 1, further comprising one or more angular structures manufactured into the curvilinear side surface.

7. A method for providing an explosive bulk charge, comprising:

providing a first contact surface configured to be selectively disposed substantially adjacent to a structure or material;

providing a second end surface configured to selectively receive a detonator; and providing a curvilinear side surface joining the first contact surface and the second end surface;

wherein the first contact surface, the second end surface, and the curvilinear side surface form a solid bi-truncated hemispherical structure formed from an explosive material.

8. The method of claim 7, wherein the first contact surface and the second end surface each have one of a substantially circular shape, a substantially elliptical shape, a rounded square shape, a rounded rectangle shape, and a combination thereof.

9. The method of claim 7, wherein the first contact surface and the second end surface comprise planar structures.

10. The method of claim 9, wherein the first contact surface and the second end surface comprise planar structures that are aligned substantially parallel with respect to one another.

11. The method of claim 7, wherein the curvilinear side surface comprises one of a smooth curved geometry, an elliptical geometry, and a parabolic geometry.

12. The method of claim 7, further comprising providing one or more angular structures manufactured into the curvilinear side surface.

13. A method for forming an explosive bulk charge, comprising:

forming a first contact surface from an explosive material, the first contact surface configured to be selectively disposed substantially adjacent to a structure or material;

forming a second end surface from the explosive material, the second end surface configured to selectively receive a detonator; and forming a curvilinear side surface joining the first contact surface and the second end surface from the explosive material;

wherein the first contact surface, the second end surface, and the curvilinear side surface form a solid bi-truncated hemispherical structure formed from the explosive material.

14. The method of claim 13, wherein the first contact surface and the second end surface each have one of a substantially circular shape, a substantially elliptical shape, a rounded square shape, a rounded rectangle shape, and a combination thereof.

15. The method of claim 13, wherein the curvilinear side surface comprises one of a smooth curved geometry, an elliptical geometry, and a parabolic geometry.

* * * * *